US008807046B2

(12) United States Patent
Fulton et al.

(10) Patent No.: US 8,807,046 B2
(45) Date of Patent: Aug. 19, 2014

(54) DEVICE AND METHOD FOR CLEANING MODEL TRAIN TRACK

(75) Inventors: C. Dwayne Fulton, Osage Beach, MO (US); Jeffery A. King, Preston, MO (US)

(73) Assignee: David L. Osment, Naples, FL (US)

( * ) Notice: Subject to any disclaimer, the term of this patent is extended or adjusted under 35 U.S.C. 154(b) by 0 days.

(21) Appl. No.: 13/248,407

(22) Filed: Sep. 29, 2011

(65) Prior Publication Data

US 2013/0081552 A1 Apr. 4, 2013

(51) Int. Cl.
*B61F 19/00* (2006.01)
*B08B 1/00* (2006.01)

(52) U.S. Cl.
CPC ..... *B08B 1/00* (2013.01)
USPC ..... 104/279; 15/54

(58) Field of Classification Search
USPC ..... 104/279, DIG. 1; 105/238.2; 15/54, 55, 15/97.1
See application file for complete search history.

(56) References Cited

U.S. PATENT DOCUMENTS

| | | | | |
|---|---|---|---|---|
| 5,651,835 | A | 7/1997 | Skidmore | |
| 5,816,168 | A | 10/1998 | Poissant | |
| 5,904,100 | A | 5/1999 | Findley et al. | |
| 6,119,298 | A * | 9/2000 | Kenmochi | 15/231 |
| 6,536,355 | B1 | 3/2003 | Amemiya | |
| 6,758,145 | B1 * | 7/2004 | Hefter | 104/279 |
| 6,904,847 | B2 | 6/2005 | Bielka | |
| 7,284,293 | B1 * | 10/2007 | Holder et al. | 15/104.94 |
| 7,597,049 | B2 * | 10/2009 | Leonowicz | 105/1.5 |

FOREIGN PATENT DOCUMENTS

| | | | |
|---|---|---|---|
| DE | 202008008432 | U1 | 9/2008 |
| WO | WO 2005/023080 | A2 | 3/2005 |

OTHER PUBLICATIONS

Product Information; Trackman 2000; http://www.elmassian.com/20-train/track?start=10, published at least as early as Aug. 21, 2009.
Product Information, Track Scrubbing Car; http://www.elmassian.com/20-train/track?start=10,; published at least as early as Dec. 11, 2008.
Product Information; Tomix Product; http://www.trainweb.org/tomix/intro/intro.htm#cleaner; published at least as early as Jun. 4, 2010.
Product Information Atlas HO Track Cleaning Car; http://www.atlasrr.com/hofreight/hotrackcleaningcar.htm; published at least as early as Oct. 6, 2009.

(Continued)

*Primary Examiner* — R. J. McCarry, Jr.
(74) *Attorney, Agent, or Firm* — Stinson Leonard Street LLP

(57) ABSTRACT

A model train track rail cleaning device includes a base, a cleaning pad mounted to the bottom of the base and a grip body coupled with the top of the base. The cleaning pad has a set of grooves positioned parallel to one another and spaced to receive track rails when the pad is in a first orientation. The cleaning pad also has a second set of grooves positioned parallel to one another and perpendicular to the first set. The second set of grooves is spaced to receive track rails when the pad is in a second orientation. Preferably, the first set of grooves is spaced to receive the rails on model track of a first size and the second set of grooves is spaced to receive the rails on model track of a second size. The cleaning device is pushed and pulled across the rails to clean them.

31 Claims, 2 Drawing Sheets

(56) References Cited

OTHER PUBLICATIONS

Product Information; The HO Dual Motorized Track Cleaning Car; http://www.mnpinc.com/ho__scale.htm; published at least as early as Sep. 5, 2008.
Product Information; Aztex Model Railroad Accessories; http://www.aztectrains.com/; published at least as early as Dec. 8, 2008.
Product Information; HO Scale Maintenance of the Way 1-Roller Track Cleaning Car; http://www.aztectrains.com/HO__4.html; published at least as early as Dec. 8, 2008.
Product Information; CMX N Scale "The Clean Machine" Ultimate Track Cleaning Car w/Micro-Trains Couplers; http://www.intemettrains.com/merchant2/merchant.mvc?Screen=PROD &Store__Code=IT&Product__Code=CMX-TTE-CMXN&Category__Code=NSCRLSCLNCMX&Featured=; published at least as early as May 28, 2010.
Product Information; Bright Boy Abrasive Track Cleaner; http://www.walthers.com/exec/productinfo/949-521; published at least as early as Jun. 22, 2009.
Product Information; Bright Bar, 240 Grit; http://www.micromark.com/Bright-Bar-240-Grit,7483.html; published at least as early as Nov. 12, 2009.
Product Information; Peco PL-41 Abrasive Rubber Block Rail/Track Cleaner; http://www.modeltrainstuff.com/Peco-PL-41Abrasive-Rubber-Block-Rail-Track-Cl-p/pec-p141.htm; published at least as early as Dec. 16, 2009.
Product Information; Wahl Clipper Oil; http://www.micromark.com/wahl-clipper-oil-4-oz,7877.html; published at least as early as Aug. 25, 2010.
Product Information; HO Gauge Track Cleaner; http://www.micromark.com/ho-qauqe-track-cleaner,8301.html; published at least as early as Mar. 18, 2009.
Product Information; O Gauge Track Cleaner; http://www.micromark.com/o-gauge-track-cleaner,8309.html; published at least as early as Mar. 18, 2009.
Product Information; N Gauge Track Cleaner; http://www.micromark.com/n-gauge-track-cleaner,8310.html; published at least as early as Mar. 18, 2009.
Product Information; Extra Cleaning Heads for HO Gauge Track Cleaner; http://www.micromark.com/extra-cleaning-heads-for-ho-gauge-track-cleaner-pkg-of-2,8320.html; published at least as early as Mar. 18, 2009.
Product Information; Extra Cleaning Heads for N Gauge Track Cleaner; http://www.micromark.com/extra-cleaninq-heads-for-n-gauge-track-cleaner-pkg-of-2,8321.html; published at least as early as Mar. 18, 2009.
Product Information; Extra Cleaning Heads for O Gauge Track Cleaner; http://www.micromark.com/extra-cleaning-heads-for-o-gauge-track-cleaner-pkg-of-2,8322.html; published at least as early as Mar. 18, 2009.
Product Information; Extra Cleaning Heads for G Gauge Track Cleaner; http://www.micromark.com/extra-cleaning-heads-for-g-gauge-track-cleaner-pkg-of-2,8323.html; published at least as early as Mar. 18, 2009.
Product Information; HO Gauge Track Cleaner; http://www.micromark.com/ho-gauge-track-cleaner8301.html; published at least as early as Mar. 18, 2009.
Product Information; 18" Gumbuster EZN; http://www.cleantrains.com/id20.htm; published at least as early as May 31, 2006.
Robert Bielka; A Locomotive Wheel Cleaner; Model Railroader; Jun. 2003 p. 41(1page).
Product Information; 'Speedi' Driver Cleaner; http://www.kadee.com/html/236-843ins.pdf; published at least as early as Sep. 16, 2008.
Product Information; Standard Speedi Driver Cleaner; http://www.micromark.corn/Standard-Speedi-Driver-Cleaner,8630.html; published at least as early as Nov. 10, 2009.
Product Information; Trix N/Z 66623 Electric Locomotive Wheel Cleaning Brush; http://www.modeltrainstuffcom/Trix-N-Z-Wheel-Cleaner-p/trx-66623.htm; published at least as early as Nov. 10, 2009.
Product Information; Trix N/Z 66623 Electric Locomotive Wheel Cleaning Brush; http://www.modeltrainstuff.com/Trix-N-Z-Wheel-Cleaner-p/trx-66623.htm; published at least as early as Apr. 15, 2008.
Product Information; Atlas Code 83 Easy to Use Non-Abrasive Locomotive Wheel Cleaner; http://www.rodneysrrtools.com/ho83wcinfo.html; published at least as early as Jun. 9, 2009.
Product Information; Rail Cleaner ~ Die-Cast ~ Kadee #500 trucks and Kadee #5 knuckle couplers; http://www.centerline-products.com/rail__wheel.htm; published at least as early as May 19, 2008.
Product Information; Locomotive Wheel Cleaning Station; http://www.micromark.com/locomotive-wheel-cleaning-station,7796.html; published at least as early as Nov. 10, 2009.
European Patent Office Search Report dated Jun. 28, 2013 from related European Patent Application No. 12183593.8 filed Sep. 7, 2012.

* cited by examiner

DEVICE AND METHOD FOR CLEANING MODEL TRAIN TRACK

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

Train modeling is a unique hobby that provides a creative outlet for children and adults alike. Various model track pieces and accessories are assembled into a model layout on which model trains run. The layout can be modeled in various scales or gauges. HO is one of the most popular scales among train modelers. In HO scale, every 1 inch represents 87 inches and the rails on HO scale train track are only approximately 0.65 inches apart. Smaller scales, such as N scale, are also popular. In N scale, every 1 inch typically represents 160 inches and the rails are only 0.354 inches apart.

Model trains are often powered by electricity. The train engine typically has at least two pairs of metal wheels and houses an electric motor that causes the wheels to turn. The motor in the train engine is powered by an electric current flowing through the rails of the train track. The wheels each have a rim and a rail contact surface. The rim guides the wheel along the track rail while the rail contact surface is in electrical contact with the track rail. Because the wheels are metal, they have a tendency to oxidize and often become coated with oil and grease. It is important that the track rails and the rail contact surfaces of the wheels are, clean as dirt buildup will interfere with the electrical connection and negatively affect performance.

A number of train cars can be hitched to the engine and pulled around the track. Each train car has at least two pairs of non-motorized, free-spinning wheels. Model train car wheels can be made of metal and used to conduct electric current from the track into the car to power accessories, such as lights. Some model train ear wheels arc plastic and create static electricity as they travel around the track, which attracts dust and other contaminants to the wheels and track. Regardless of what the wheels are made, the rail contact surfaces should be kept clean to prevent soiling or damaging the rails, causing uneven wear and tear to the wheels or rails, or negatively impacting conductivity between a car accessory (such as a light) and the track. Excessive dirt buildup can also cause derailment.

Model railroad tracks are typically made of steel, brass, or nickel and have a tendency to oxidize in the same manner metal train wheels do. Track rails also become coated with adhesives, grease, oil, dirt, and other materials used on the model layout. Dirty track rails can interfere with the electrical conductivity between the rails and the train wheels, thereby negatively affecting performance. On a digital command control (DCC) layout, signals are transmitted through the track to the trains. Decoders in a DCC system are susceptible to even a small amount of dirt on the rails. The rails must also be kept clean to ensure that the train wheels can gain the proper traction at all speeds and on all track grades.

Automated track cleaning devices are known in the art. Many of these automatic cleaning devices include a cleaning element attached to a train car. The cleaning element is then pulled across the rails as the train car moves around the track. There are several problems with automated track cleaning devices. First, they are dependent on conductivity to run properly. Second, they do not thoroughly clean the track. Finally, they can damage fragile portions of the track, such as switches, crossovers, turnouts and decouplers. For these reasons, model railroaders often resort to manually cleaning their tracks. On an extensive model layout, there are hard to reach portions of track, such as those beneath bridges and in tunnels, and congested areas where it is difficult to maneuver a cleaning element.

BRIEF SUMMARY OF THE INVENTION

The present invention is directed to a model train track cleaning device and a method of using the same. The device includes a base, at least one cleaning pad removably mounted on the bottom surface of the base, and a grip. The cleaning pad preferably includes at least one pair of parallel grooves extending along the bottom surface of the pad. The grip is a grip body pivotally coupled with the top surface of the base for pushing the cleaning pad across the model train track rails. The base also includes a retainer for holding the grip body in a stationary position and releasable to permit the grip body to swivel freely on top of the base. Preferably, a set of opposing linger stops extending above the top surface of the base is provided as a second grip. The device also includes a handle for pushing the base and cleaning pad across the model train track rails in harder to reach locations.

In a preferred embodiment, the cleaning pad has two pairs of parallel grooves with each pair configured to receive the rails of a different scale of model train track. Preferably the first pair of parallel grooves is configured to receive the rails of N scale track and the second pair of parallel grooves is configured to receive the rails of HO scale track. The two pairs of parallel grooves extend across the cleaning pad in different directions, preferably perpendicular to one another. In this manner, the cleaning pad can be positioned in a first orientation on the base for cleaning N scale track and positioned in a second orientation for cleaning an HO scale track.

To clean model railroad track using the track cleaning device of the present invention, a cleaning pad is mounted to the base. When mounted on the base in a first orientation, the cleaning pad is positioned to receive N scale track rails into the first pair of grooves. The cleaning pad may be rotated into the second orientation, where it is positioned to receive HO scale track rails into the second pair of grooves. The grooves ensure that the device does not slip off the track and damage surrounding pieces of the model layout as the device is pushed and pulled across the rails. A user may move the base and cleaning pad back and forth by bracing one or more fingers between the finger stops, placing one or more fingers on either side the of the grip body while the retainer holds the grip body in a stationary position, placing one or more fingers on either side of the grip body while the grip body is permitted to swivel freely, or gripping the handle.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
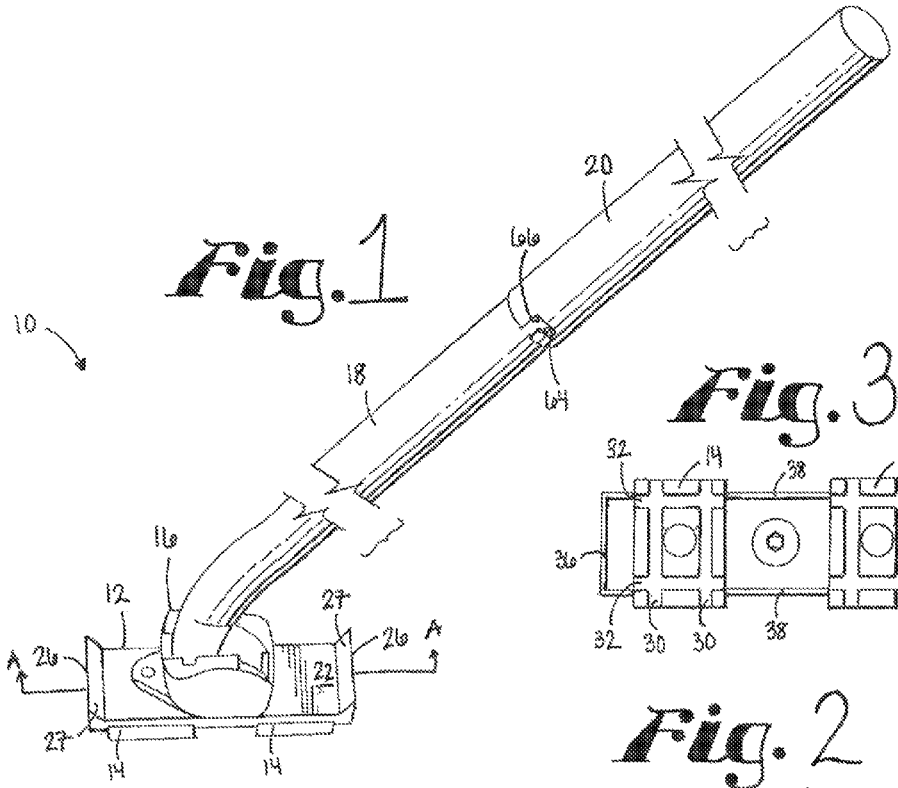
FIG. 1 is a perspective view of the cleaning device of the present invention.

The track cleaning device of the present invention is shown in FIG. 1 and is designated generally by reference numeral 10. Cleaning device 10 includes a base 12, first and second cleaning pads 14 pivotally and removably mounted to the bottom surface of base 12, and a grip body 16 pivotally mounted to the top surface of base 12. Handle 18 is pivotally and removably mounted to grip body 16 and handle extension 20 is removably mounted to the top of handle 18.

Figure 2:
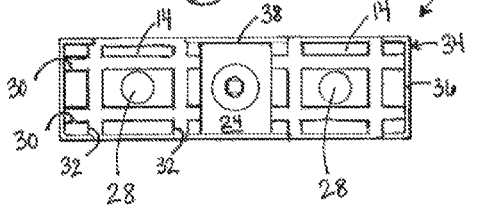
FIG. 2 is a bottom view of the cleaning device of the present invention with cleaning pads mounted in a first orientation.

With reference to FIGS. 1 and 2, base 12 comprises a generally rectangular platform with a top surface 22 and a bottom surface 24. A pair of wing-shaped finger stops 26 projects from top surface 22 at opposing ends of base 12. Each finger stop 26 has a sloped inner wall 27 against which a user can brace a finger to move base 12. Bottom surface 24 has protruding pins 28, which are integral with the platform and releasably mount cleaning pads 14.

Cleaning pads 14 each define an aperture through which one of the protruding pins 28 extends when the pad is mounted on base 12. In this manner, cleaning pads 14 are removably mounted to base 12 such that they can be replaced with new or different pads during the cleaning process. Cleaning pads 14 can also be rotated on protruding pins 28 so as to change the orientation or position of the pads relative to base 12.

With reference to FIG. 2, cleaning pads 14 are shown mounted to base 12 in a first orientation. Each cleaning pad 14 defines a pair of parallel N grooves 30 configured to receive the rails of an N scale model train track. N grooves 30 extend along the bottom surface of each cleaning pad 14 in a direction generally parallel to the longitudinal axis of base 12. Each cleaning pad 14 further defines a pair of parallel HO grooves 32 configured to receive the rails of an HO scale model train track. HO grooves 32 extend along the bottom of each cleaning pad 14 in a direction generally perpendicular to the longitudinal axis of base 12.

Figure 3:
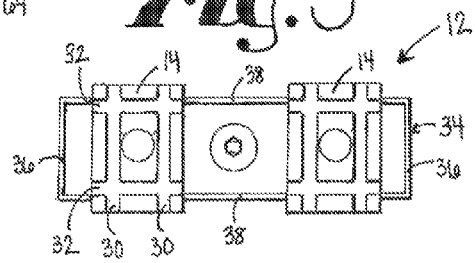
FIG. 3 is a bottom view of the cleaning device of the present invention with cleaning pads mounted in a second orientation.

A sectional raised edge 34 extends outwardly from the bottom surface of base 12. First and second end sections 36 of raised edge 34 wrap around each end of base 12 and first and second middle sections 38 are located in the middle of each side of base 12. Raised edge 34 retains cleaning pads 14 in the first orientation shown in FIG. 2 such that the sides of cleaning pads 14 abut the inner sidewall of the end portions and middle portions of the edge. As shown in FIG. 3, raised edge 34 also retains cleaning pads 14 in a second orientation where HO grooves 32 are generally parallel to the longitudinal axis of base 12 and N grooves are generally perpendicular to the longitudinal axis of base 12. In the second orientation, the end of each cleaning pad 14 extends beyond the side of base 12 and the sides of the pad are retained between the end points of end sections 36 and middle sections 38 of the raised edge.

Cleaning pads 14 may be made of a variety of materials suitable for different stages of the cleaning process. For example, pads made of a course abrasive material or a fine abrasive material are used to clean and smooth model train track. Preferred abrasive materials include high quality silicon carbide and premium grade oil-resistant chemical rubber that resists clogging. Cleaning pads made of an absorbent material, such as felt, are used to remove grease and oils from model train track. Absorbent pads can also be used in conjunction with a liquid cleaning solution. A preferred cleaning solution acts as an emulsifier and assists in grease and oil removal. Cleaning pads made of a dusting or polishing material, such as a fine felt or woven textile, are used to remove fine dirt at the end of the cleaning process.

Figure 4:
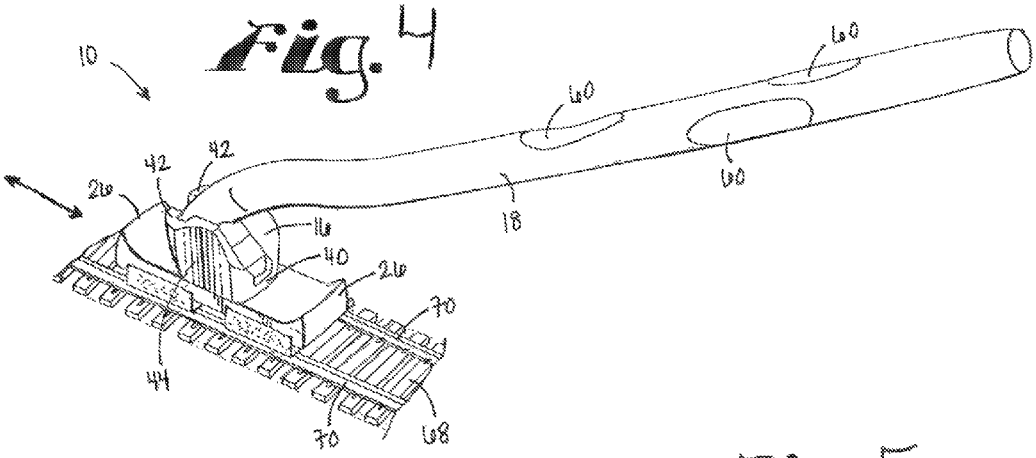
FIG. 4 is a perspective view of the cleaning device of the present invention in use on a model train track.
Figure 5:
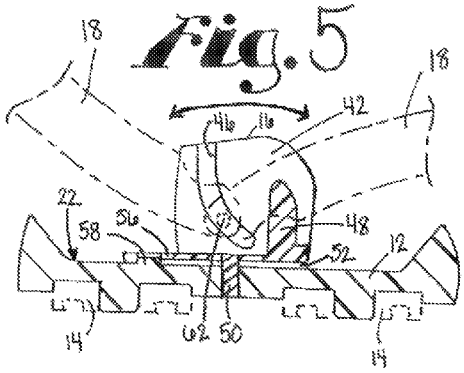
FIG. 5 is a cross-section, taken along line A-A in FIG. 1, of the base and grip body of the cleaning device of the present invention.

With reference to FIG. 4, grip body 16 is generally u-shaped, having a flat, bottom plate 40 extending between two sidewalls 42. The outside surface of each sidewall 42 defines a concave finger hold 44 for grasping grip body 16 during use. With reference to FIG. 5, a cross-section of base 12 and grip body 16 taken along line A-A in FIG. 1 is shown. The inside surface of each sidewall 42 defines a receiving channel 46. Receiving channel 46 has an opening at the top of grip body 16 and curves down toward the bottom of the grip body. At one end of grip body 16, a partial end wall 48 extends between sidewalls 42. Grip body 16 is pivotally connected to base 12 using a pin 50. A pad 52 is provided between grip body 16 and base 12 to reduce the amount of friction between grip body 16 and base 12 as grip body 16 rotates. Pad 52 is preferably made of a slick material having a low coefficient of friction. Grip body 16 also includes a flat foot 56 configured to cooperatively interact with a locking projection 58 that extends above top surface 22 of base 12. Foot 56 is contiguous with and extends laterally away from grip body 16 and defines an aperture into which locking projection 58 may be received to hold grip body 16 in the stationary position.

With further reference to FIG. 5, handle 18 is shown pivotally and removably coupled with grip body 16. Handle 18 is an elongated rod having a plurality of concave gripping portions 60 (as shown in FIG. 4). A dowel 62 extends from either side of one end of handle 18. Dowel 62 slides into receiving channels 46 to mount handle 18 to grip body 16. When fully inserted, handle 18 is capable of pivoting approximately 180° from a first side of grip body 16 to a second side. Handle 18 may also rest on end wall 48 in an optimal position for pushing and pulling cleaning pads 14 across model train track rails.

With reference to FIG. 1, handle extension 20 is removably attached to a second end of handle 18. At this end, handle 18 includes a nub 64. Handle extension 20 defines an L-shaped slot 66. To attach handle extension 20 to handle 18, nub 64 is inserted into a first portion of L-shaped slot 66 and then handle extension 20 is rotated to position nub 64 in a second portion of L-shaped slot 66.

Figure 6:
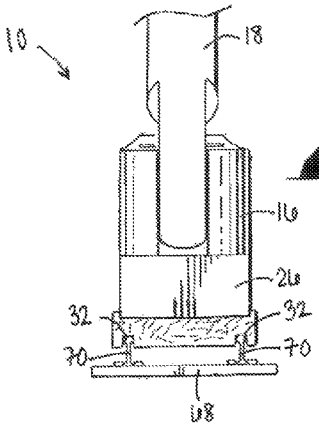
FIG. 6 is an end view of the cleaning device of the present invention in use on a model train track.

With reference to FIGS. 4 and 6, device 10 is shown positioned on HO scale model train track 68 having rails 70. Handle 18 is used to push and pull cleaning pads 14 across rails 70 to clean them. As shown in FIG. 6, rails 70 are received into HO grooves 32. Grooves 32 prevent cleaning pads 14 from slipping off rails 70 and damaging surrounding components of the model layout. During use, handle 18 can pivot from one side of grip body 16 to the other to maneuver around items on a track layout, such as bridges, telephone wires, and trees. Handle 18, in conjunction with handle extension 20, can be used to push base 12 and cleaning pads 14 into hard to reach places on the layout, such as inside tunnels. Alternatively, handle 18 may be removed and grip body 16 or finger stops 26 may be used to push and pull cleaning pads 14 across rails 70. When handle 18 or grip body 16 is used, grip body 18 may be retained in a stationary position or permitted to swivel freely depending on the desired level of control over the direction of movement of device 10.

In an alternative embodiment, cleaning pad 14 has a flat surface and no grooves are provided. Flat cleaning pads are used to clean turnouts, switches, crossovers, decouplers, or other areas that will not accommodate a grooved pad. When using a cleaning pad with a flat surface, the retainer is used to hold grip body 16 in a stationary position so as to provide better control over cleaning device 10. Cleaning pads 14 may also have grooves on one side and a flat surface on the side. To change from the grooved side to the flat side, the cleaning pad is removed from the protruding pin on the base, turned over, and remounted. In a second alternative embodiment, cleaning pads 14 have an assortment of shapes, including but not limited to square and circular. The shape of base 12 and position of sectional raised edge 34 may be made to accommodate these alternative shapes. The shape of the protruding pin may also include a key-like projection. Forcing a pin with a key-like projection into the round aperture of the cleaning pad creates a friction fit that helps retain the pad on the pin and prevents the cleaning pad from spinning around the pin during use. In a third alternative embodiment, grooves 30 and 32 are of a size and shape and spaced to receive the rails of any model track scale, including but not limited to Z, O, and G scales. Grooves 30 and 32 may be sized to fit different scales (as described with regard to the preferred embodiment) or may be sized to fit the same scale. In scales, such as O scale, the track may have a third rail, in which case cleaning pads, having a third groove to receive the third rail in one or both orientations, are provided. In a further alternative embodiment, handle extension 20 is a piece of galvanized metal conduit or PVC pipe that fits on the distal end of handle 18. The metal conduit or PVC pipe may be cut to any length and may be several feet long. Alternatively, handle 18 and handle extension 20 are replaced with a telescoping handle that can be adjusted to a variety of lengths on the fly.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations: This is contemplated by and is within the scope of the claims.

What is claimed and desired to be secured by Letters Patent is as follows:

1. An apparatus for cleaning the rails on model train track, said apparatus comprising:

a base having a top surface, a bottom surface, a raised portion around at least a portion of the perimeter of said bottom surface, and at least one protruding pin extending from said bottom surface;

at least one cleaning pad defining an aperture through which said protruding pin extends, wherein said cleaning pad is removably mounted to said bottom surface of said base;

wherein said raised portion is capable of retaining said cleaning pad in a first orientation and a second orientation relative to said base; and a grip body pivotally coupled with said top surface of said base for pushing said cleaning pad across said rails.

2. The apparatus of claim 1, further comprising a pad positioned between said base and said grip body for reducing friction between said base and said grip body.

3. The apparatus of claim 1, wherein said raised portion comprises first and second end sections and first and second middle sections.

4. The apparatus of claim 1, wherein said cleaning pad defines first and second grooves positioned parallel to one another and spaced to receive said rails when said cleaning pad is in said first orientation.

5. The apparatus of claim 4, wherein said cleaning pad defines third and fourth grooves positioned parallel to one another, said third and fourth grooves spaced to receive said rails when said cleaning pad is in said second orientation.

6. The apparatus of claim 5, wherein said first and second grooves are perpendicular to said third and fourth grooves.

7. The apparatus of claim 5, wherein said first and second grooves are spaced to receive the rails on model train track of a first size and said third and fourth grooves are spaced to receive the rails on model train track of a second size.

8. The apparatus of claim 1, further comprising a first and second finger stop extending above said top surface of said base for pushing said cleaning pad across said rails.

9. The apparatus of claim 1, further comprising a retainer configured to hold said grip body in a stationary position and releasable to permit said grip body to swivel freely.

10. The apparatus of claim 1, further comprising an elongated handle pivotally coupled with said grip body.

11. The apparatus of claim 10, wherein said handle pivots between a first side of said grip body and a second side of said grip body.

12. The apparatus of claim 1, further comprising a handle extension removably coupled with said handle.

13. A model train track rail cleaning system comprising:

a base having a top surface, a bottom surface, and a raised portion around at least a portion of the perimeter of said bottom surface;

at least one cleaning pad removably mounted to said bottom surface of said base, wherein said raised portion is capable of retaining said cleaning pad in a first orientation and a second orientation relative to said base and wherein said cleaning pad defines first and second grooves positioned parallel to one another and spaced to receive model train track rails when said cleaning pad is in said first orientation and said cleaning pad defines third and fourth grooves positioned parallel to one another and spaced to receive model train track rails when said cleaning pad is in said second orientation; and a grip body pivotally coupled with said top surface of said base for pushing said cleaning pad across said rails.

14. The system of claim 13, further comprising a pad located between said base and said grip body for reducing friction between said base and said grip body.

15. The system of claim 13, wherein said base further comprises a retainer configured to hold said grip body in a stationary position and releasable to permit said grip body to swivel freely.

16. The system of claim 13, wherein said grip further comprises a set of opposing finger stops extending above said base.

17. The system of claim 13, further comprising a handle pivotally coupled with said base.

18. The system of claim 17, further comprising a handle extension removably coupled with said handle.

19. The system of claim 13, further comprising a handle pivotally coupled with said grip body.

20. The system of claim 13, wherein said cleaning pad comprises a material selected from the group consisting of an abrasive material, an absorbent material, and a dusting material.

21. The system of claim 20, further comprising an abrasive pad, an absorbent pad, and a dusting pad.

22. The system of claim 21, further comprising written instructions for use of said base with said abrasive pad, said absorbent pad and said dusting pad.

23. The system of claim 13, wherein said first and second grooves are perpendicular to said third and fourth grooves.

24. The system of claim 13, wherein said first and second grooves are spaced to receive the rails on model train track of a first size and said third and fourth grooves are spaced to receive the rails on model train track of a second size.

25. A method of cleaning the rails on model train track, said method comprising:

providing a base having a top surface, a bottom surface, and a raised portion around at least a portion of the perimeter of said bottom surface;

providing at least one cleaning pad, wherein said raised portion is capable of retaining said cleaning pad in a first orientation and a second orientation relative to said base and wherein said cleaning pad defines first and second grooves positioned parallel to one another and spaced to receive model train track rails when said cleaning pad is in said first orientation and said cleaning pad defines third and fourth grooves positioned parallel to one another and spaced to receive model train track rails when said cleaning pad is in said second orientation;

providing a grip body pivotally coupled with said top surface of said base;

mounting said cleaning pad to said base in said first orientation; and moving said cleaning pad across said rails using said base.

26. The method of claim 25, further comprising providing a handle and coupling said handle with said base.

27. The method of claim 25, wherein said first and second grooves are spaced to receive model train track rails of a first size when said cleaning pad is in said first orientation and said third and fourth grooves are spaced to receive model train track rails of a second size when said pad is in said second orientation.

28. The method of claim 27, further comprising rotating said cleaning pad from said first orientation to said second orientation.

29. The method of claim 25, wherein said first and second grooves are perpendicular to said third and fourth grooves.

30. A cleaning pad for cleaning the rails on model train track, said cleaning pad comprising:

a pad having a cleaning surface and defining a first groove and a second groove in said cleaning surface, said first and second grooves positioned parallel to one another and spaced to receive said rails of a model train track of a first size;

said pad further defining a third groove and a fourth groove in said cleaning surface, said third and fourth grooves positioned parallel to one another, spaced to receive said rails of a model train track of a second size, and positioned perpendicular to said first and second grooves; and said pad further defining an opening for receiving a pin, wherein said pad is capable of rotating on said pin from a first orientation whereby said first and second grooves are oriented for receiving said rails of said model train track of said first size, to a second orientation whereby said third and fourth grooves are oriented for receiving said rails of said model train track of said second size.

31. The cleaning pad of claim 30, wherein said pad comprises a material selected from the group consisting of an abrasive material, an absorbent material, and a dusting material.

* * * * *